United States Patent [19]

Noda

[11] 4,084,299

[45] Apr. 18, 1978

[54] PLASTIC CLIP

[75] Inventor: Taizo Noda, Nishinomiya, Japan

[73] Assignee: Kohshoh Limited, Kyoto, Japan

[21] Appl. No.: 776,134

[22] Filed: Mar. 10, 1977

[30] Foreign Application Priority Data

Nov. 26, 1976 Japan ..... 51-158846[U]

[51] Int. Cl.[2] ..... A44B 21/00

[52] U.S. Cl. ..... 24/250

[58] Field of Search ..... 24/250, 258, 251, 137 R, 24/137 A, 253

[56] References Cited

U.S. PATENT DOCUMENTS

| | | | |
|---|---|---|---|
| 3,780,402 | 12/1973 | Takabayashi | 24/250 |
| 3,914,828 | 10/1975 | Noda | 24/250 |
| 4,005,510 | 2/1977 | Noda | 24/250 |

*Primary Examiner*—Kenneth J. Dorner

[57] ABSTRACT

A plastic clip comprising an upper clip member, a lower clip member, an operative member and a resilient member, in which the upper clip member is provided with a pair of outwardly extended supporting portions each having a bearing portion, while the lower clip member is provided with a pair of journals projected outwardly whereby the upper and lower clip members are pivotally connected with each other through the fitting of the journals into the bearing portions respectively.

13 Claims, 11 Drawing Figures

Figure 1:
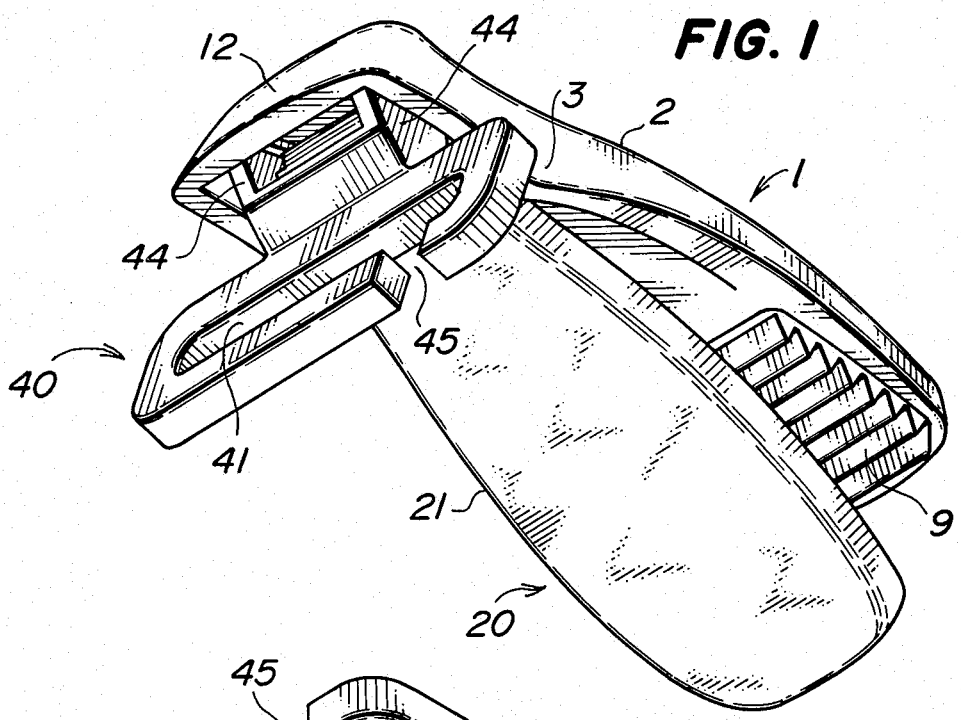

1
2
3
4
6
7
8
9
10
12
20
21
22
25
27
28
29
30
31
40
41
42
43
46
47
48
50
71
72
73
74
A

PLASTIC CLIP

The present invention relates to a clip to be fitted to one end of a suspender or used as a laundry clip and the like.

In general, such a clip comprises a pair of pivotally connected metal or plastic members. And in the conventional type clip, such two members are provided with a pivot-forming portion i.e. opening, and a pin was made to pass through the bore and then both end portions of the pin were caulked to form a pivot. However, such type clip needs to be small in size, and therefore to form the pivot is difficult, resulting in a severe problem in manufacturing the same.

Lately, as disclosed in U.S. Pat. No. 3,780,402, a clip has been suggested which can be assembled without using any pin. However, in this clip an auxiliary groove for fitting a shaft is provided on the inside of the supporting portion of one clip member, which becomes gradually small in depth from the top to the opening and terminates before reaching the opening, and the other plate member is provided with a shaft partly cut away at its surface facing the said auxiliary groove whereby the two plate members are urged in face-to-face relation with each other to fit the shaft into the opening using the characteristics of the plastic material. Though in this clip, the pivot section can be more easily assembled than in a clip in which a pin is used, the supporting portions having openings are provided to project vertically with respect to the plate members, so that strong pressing force is required for fitting the shaft into the openings and sometimes the application of such a strong force gives damage to the supporting portions.

Further it is very difficult to form the openings in the supporting portions integrally and at the same time with the vertically protruded supporting portions. Therefore, in manufacturing the abovementioned clip, firstly, only the supporting portions are integrally formed and then the openings in the supporting portions, which process requires much time and labor.

Furthermore, to eliminate the abovementioned disadvantages, a clip is proposed in Japanese Utility Model Application No. 21219/76, in which the supporting portions are formed to project outwardly. According to this clip, the said disadvantages can be eliminated, but this clip is not sufficient especially in view of preventing the breakage of the lower clipping member and the operative member.

That is, one side of the L-shaped operative member is positioned in a rear space defined by the opposed inner surface of the upper and lower clip members respectively, and when the clipping portion are in open position, the side is disposed in parallel with the upper or lower clip member while when the clipping portions are in closed position, the said side is positioned substantially perpendicularly to the clip members i.e. to regist against pivotal opening force, the slidable end of the said side in contact with the upper clip member is positioned rather nearer to the shaft than the other slidable end of the said side is. Thus, the clipping portions are opened or closed by changing the position of one side of the L-shaped operative member. And when the said side is changed its position in the space from the open position to the closed position, both of the ends of the said side slide on the inner surface of the upper and lower clip members respectively. This sliding movement is carried out by two steps, i.e. one end slides and then the other end does. In these two steps of sliding movement, the most excessive force is applied on the clip members and the operative member in the first step of the sliding movement. Especially in the operation for clipping a thick article, this first step of sliding movement sometimes cannot be carried out, and if, against this, a strong force is compulsorily applied on the operative member for clipping the article, the operative member, the upper clip member or the lower clip member may be broken. In order to prevent such breakage, for example, the upper and lower clip members may be formed to be large in thickness, but it is not desirable since this kind of clip is required to be thin especially when used on closing. Further, in order to prevent the breakage of the operative member, the operative member may be also formed to be large in thickness, but since one side of the operative member is positioned in a rear space defined by the opposed inner surfaces of the upper and lower clip members as abovementioned, it cannot be too thick. That is, this kind of clip is preferably small in thickness as well as in size and at the same time the distance between the clipping portions is of a predetermined value when the clip members are in open position. To obtain a clip which is small in size and at the same time has a predetermined distance between the clipping portions, the pivotal shaft is to be positioned as far as possible from the clipping portions, which results in extremely small space in which the said one side of the operative member is positioned, and thus not permitting the one side of the operative member to be so large in thickness. Further, in this case, a considerably strong force is to be applied on the operative member to bring the clipping portions in closed position. Further, in a clip in which one side of the operative member is adapted to be positioned in such a space, the thickness of the side is naturally added to that of the clip, so that the clip becomes substantially large in thickness and thus unsatisfactory when a thin clip is desired.

In view of the abovementioned respects, an object of the present invention is to provide a clip which can be manufactured extremely easily and economically and assembled very easily and rapidly.

Another object of the present invention is to provide a clip in which damage given to the clip in manufacturing and use can be reduced, a considerably great clipping force can be obtained even in clipping a thick article and the clipping portions can be always kept in closed position as long as the operative member is not intentionally operated by hand or others.

A further object of the present invention is to provide a clip which is excellent in appearance, thin and of small size.

According to the present invention, a clip comprises an upper clip member, a lower clip member, an operative member and a resilient member. The upper and lower clip members and the operative member are integrally formed respectively preferably of synthetic resin material e.g. polypropylene, ABS, polycarbonate, polyacetal or the like. The resilient member may be formed of such synthetic resin, but preferably is integrally formed e.g. of spring steel or other metal material. The upper clip member has supporting portions each provided with a bearing portion. The supporting portions are formed integrally with an upper plate to extend outwardly from the opposite rear side portions of the upper plate. By selecting such a formation of the supporting portions, the molding thereof becomes very simple, the bearing portions can be formed at the same time with the supporting portions, and further no damage is given to the supporting portions in assembling the clip by fitting the journals of the lower clip member into the bearing portions respectively.

The end portion of arms of the operative member slides in contact with the inner surface of the upper plate in the rear parts of the supporting portions. The lower clip member is provided with journals extended outwardly in correspondence with the bearing portions of the upper clip member. That is, these are adapted to be fitted into the bearing portions and positioned on the axis of a pair of supporting portions formed integrally with the lower clip member on the rear portion of the inner surface of the lower plate of the lower clip member. The upper and lower clip members are pivotably connected with each other by means of the journals and the beariang portions. Further, a semi-circular-sectioned engagement groove is provided in the inner surface of the lower plate behind the journals of the lower clip member. A pivotal shaft of the operative member is engaged with the engagement groove, and this engagement permits the pivotal movement of the operative member with respect to the lower clip member. The operative member comprises an attachment plate portion, a side wall section integrally extended from the attachment plate portion, a pivotal shaft and arms provided at the end portion of the side wall section. The attachment plate portion is provided with a slit for attaching the clip to a looped end of a belt or the like. The pivotal shaft of the operative member functions as a supporting point of a lever when engaged with the engagement groove of the lower clip member. Further, the attachment plate portion functions as the point of force of the lever and the edge of the arms of the operative member as the point of application. Between the side walls integrally extended from the attachment plate portion, the rear end of the lower plate portion of the lower clip member is positioned. Therefore, when the clipping portions are in closed position, the pivotal shaft and the arms of the operative member are positioned in a space defined by the rear end portions of the pivotally connected upper and lower clip members respectively. The spring member to be mounted between the opposed surfaces of the upper and lower clip members respectively comprises e.g. a spiral member with its two ends extended or a plate member.

A preferred embodiment of the present invention will be now described with reference to the appended drawings.

Figure 2:
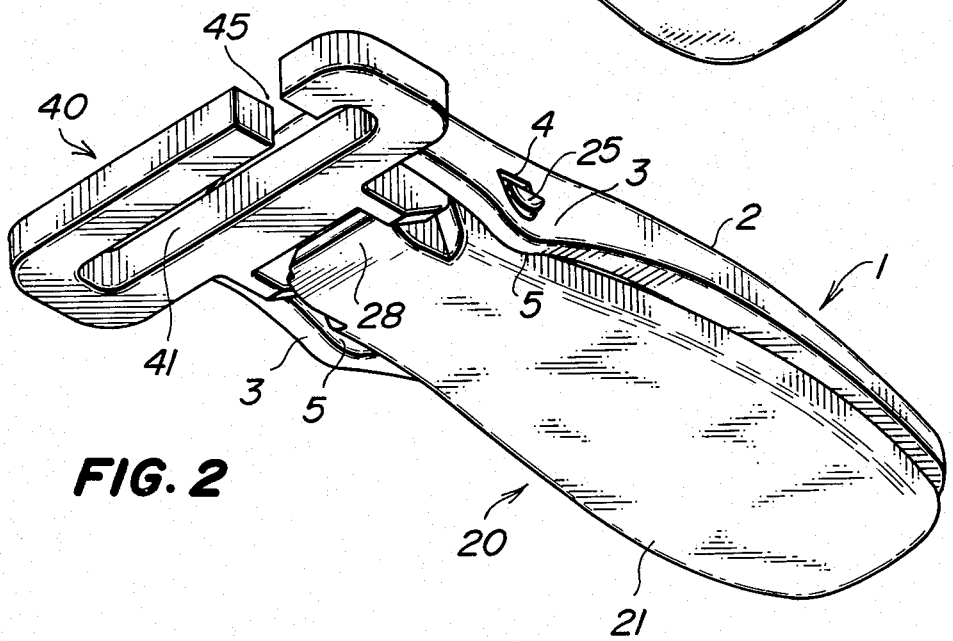
Figure 3:
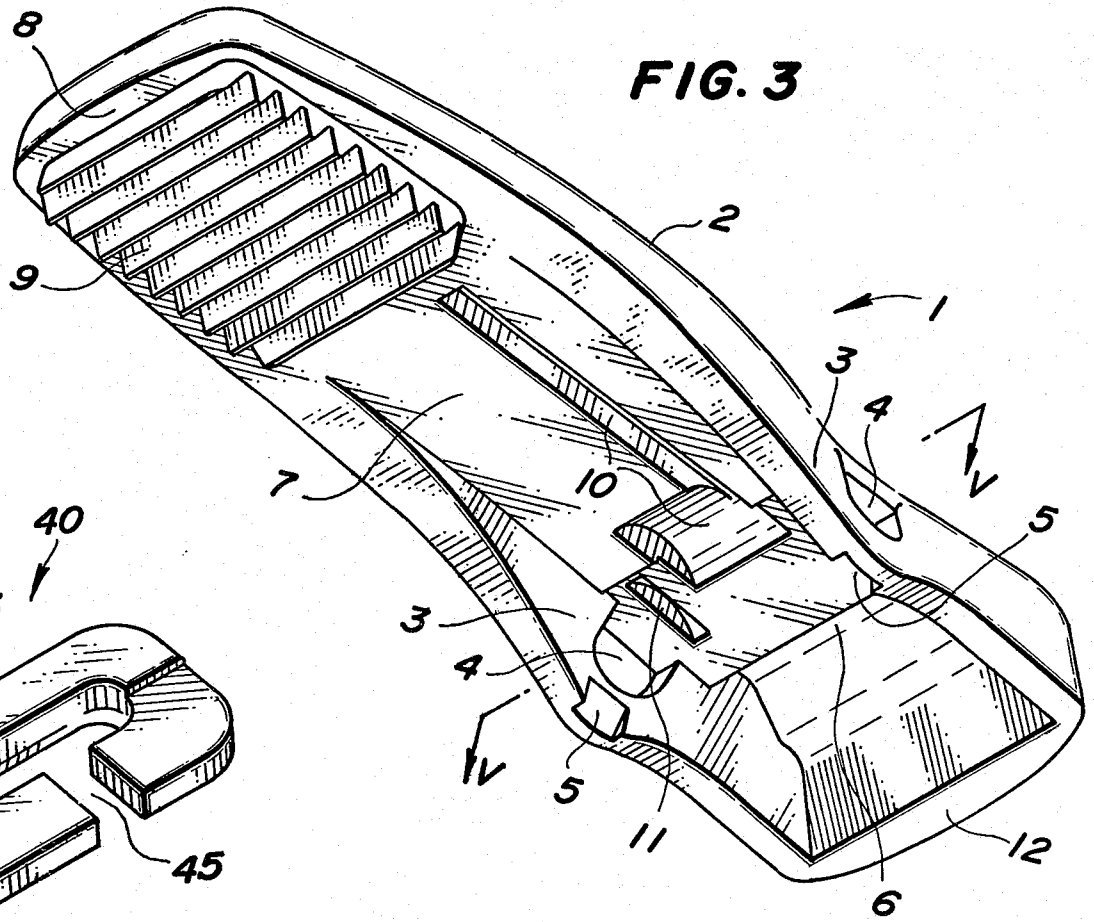
Figure 5:
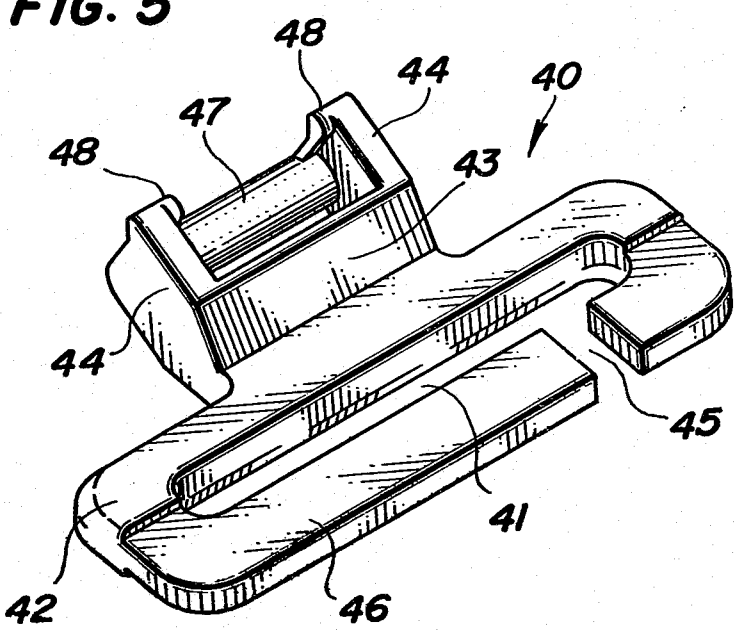
Figure 4:
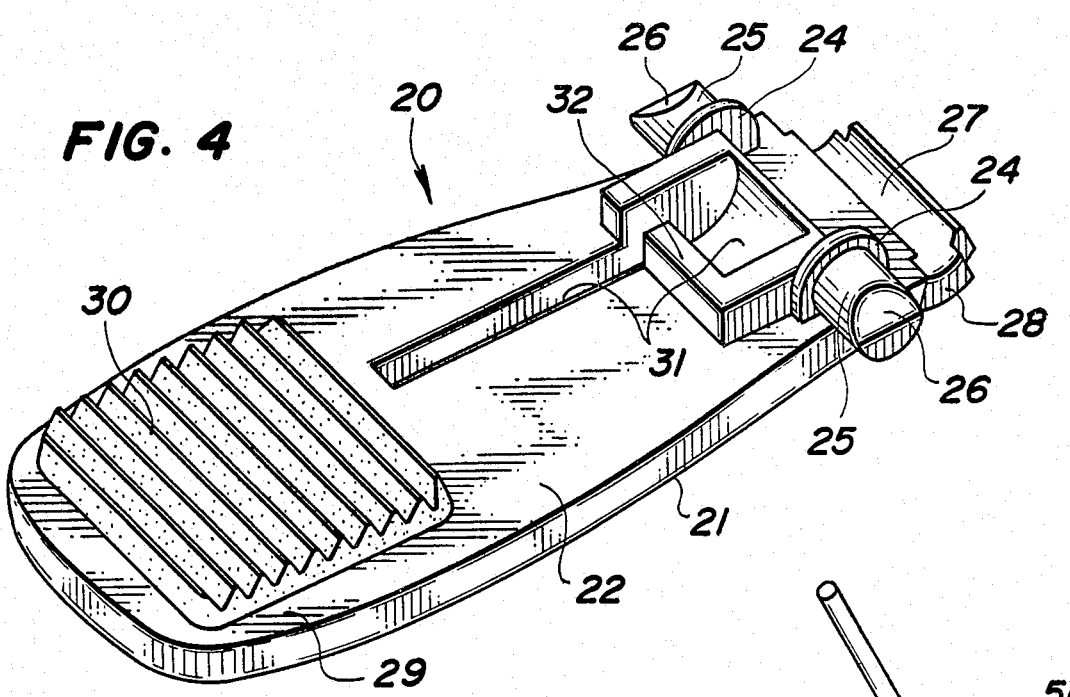
Figure 6:
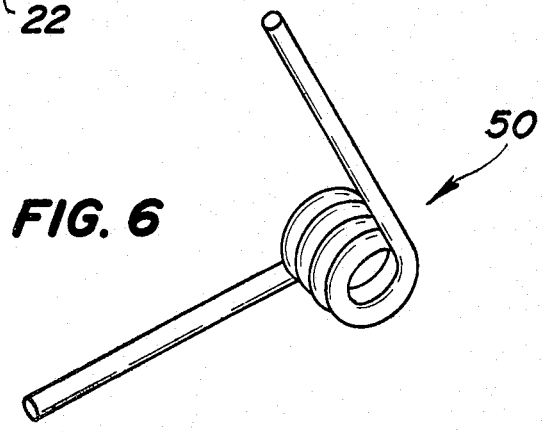
Figure 7:
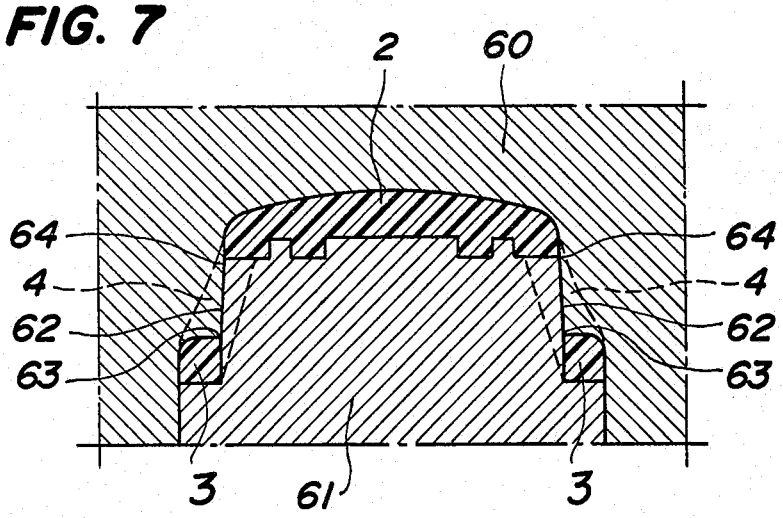
Figure 8:
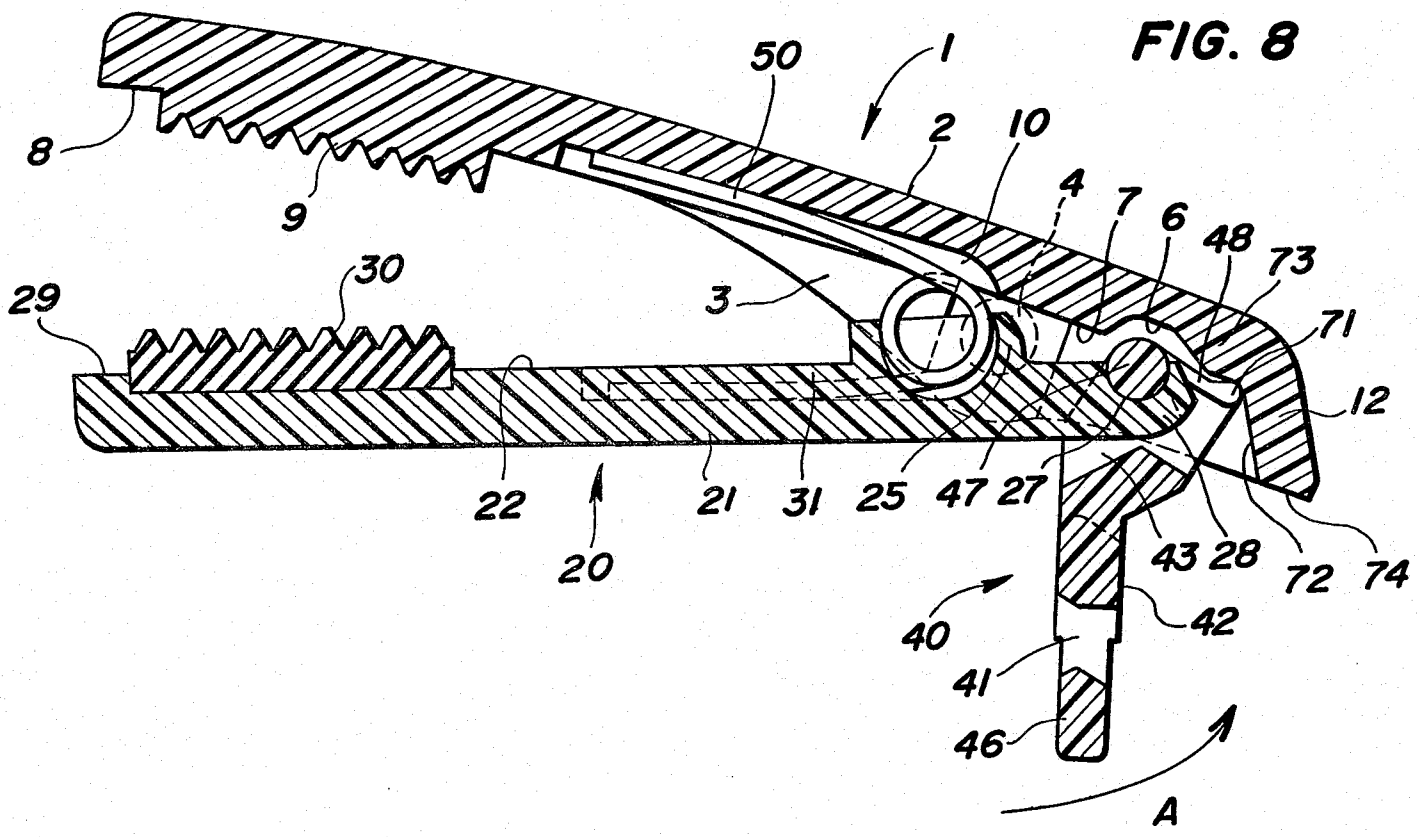
Figure 9:
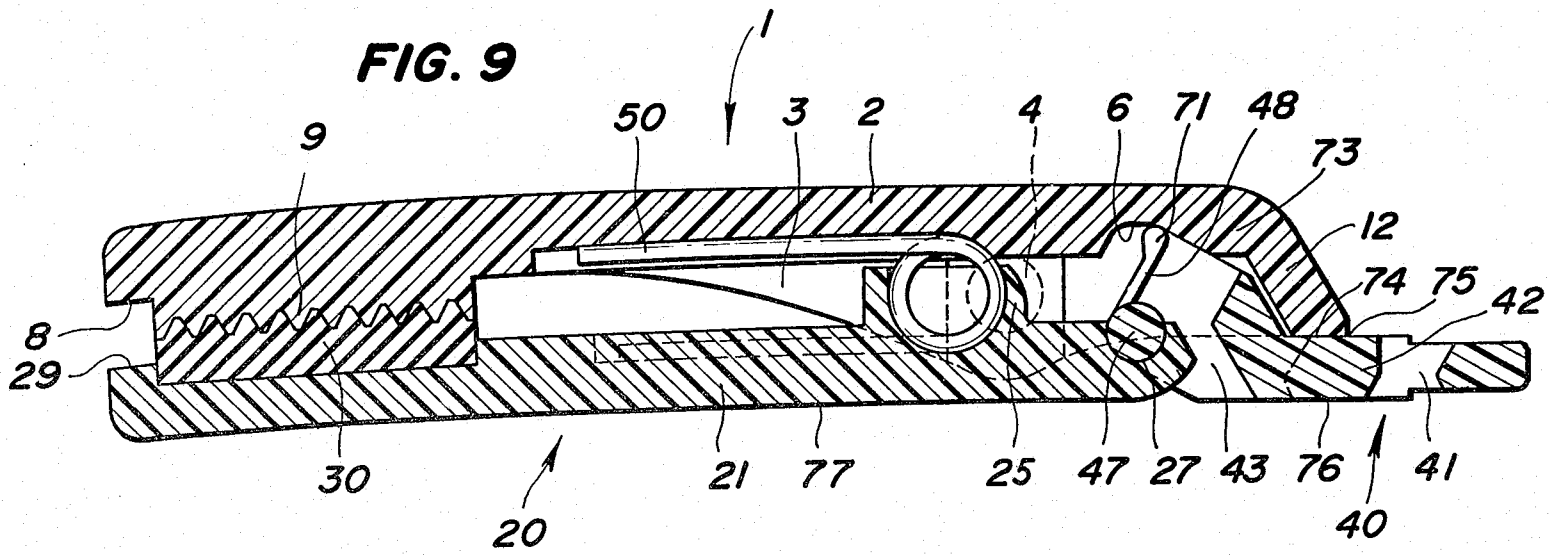
Figure 11:
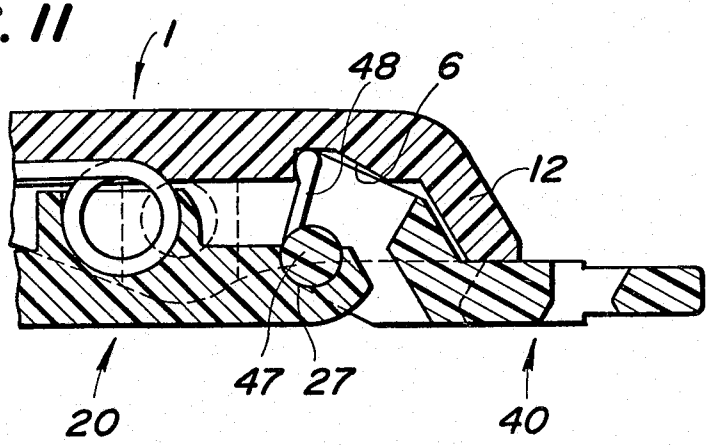
Figure 10:
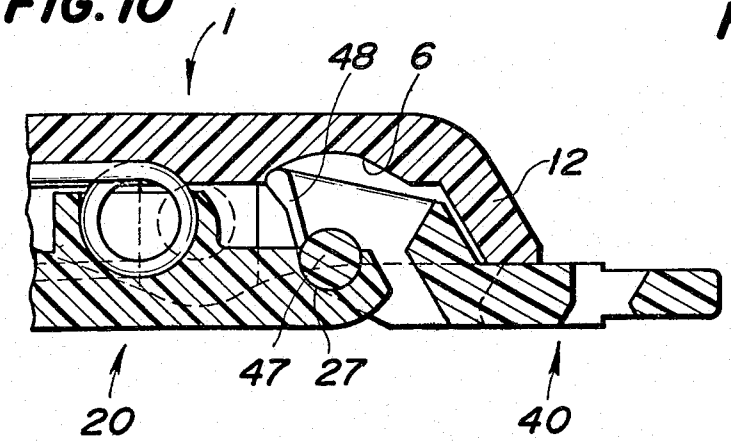

FIG. 1 is a perspective view of a preferred embodiment of a clip of the present invention illustrating a clipping portion in an open position, FIG. 2 is a perspective view similar to FIG. 1 illustrating the clipping portion in a closed position, FIG. 3 is a perspective view of an upper clip member shown in FIG. 1, FIG. 4 is a perspective view of a lower clip member shown in FIG. 1, FIG. 5 is a perspective view of an operative member shown in FIG. 1, FIG. 6 is a perspective view of an elastic member shown in FIG. 1, FIG. 7 is a sectional view taken substantially along the line V — V of FIG. 3 illustrating the upper clip member with the molding form thereof, FIG. 8 is a sectional view of the embodiment of the invention seen in the position of FIG. 1, FIG. 9 is a view similar to FIG. 8 but seen in the position of FIG. 2, FIG. 10 is a sectional view of another modification of the operative member shown in FIG. 5, FIG. 11 is a sectional view of another embodiment of the upper clip member shown in FIG. 3.

In the exemplary embodiment of the invention described hereinafter, like numerals designate like or corresponding parts having like structures and functions, wherein no repeated explanations are given.

An upper clip member 1 comprises an upper plate portion 2 and supporting portions 3, 3 formed integrally with the upper plate portion 2 so as to be extended outwardly from the rear side portions respectively of the upper plate portion 2. The supporting portions 3, 3 are provided with bearing portions 4, 4 respectively comprising openings. Preferably by providing guide grooves 5, 5 in the inner surfaces respectively of the supporting portions 3, 3 so as to run from the top end thereof to the bearing portion 4, journals 25, 25 can be more easily fitted into the bearing portions 4, 4. A semi-circular-sectioned slide groove 6 is provided behind the bearing portions 4, 4 in the inside 7 of the upper plate portion 2. The slide groove 6 may be formed to have a curved surface substantially the same with the locus given by the end portions 71, 71 of the arms 48, 48. Further, a part of the curved surface of the slide groove 6 on which the end portions 71, 71 of the arms 48, 48 may be formed to be a plane. That is, the slide surfaces contacting the end portions of the arms are so formed that the arms 48, 48 of the operative member 40 operate after once providing the greatest clipping force to the clipping portions in opening and closing operations. That is, for example, when the slide surfaces are planes, the end portions of the arms are so formed as to be positioned on the side of the pivot beyond the plane vertical to the slide surface when the clipping portions are in closed position. Further, the curved surface is preferably so formed that a force to allow the pivotal movement of the end portions of the arms 48, 48 in the direction of the bearing portions 4, 4 is applied on the arms 48, 48. The rear end wall 12 is integrally formed with the upper plate portion 2 so as to be bent inwardly from the rear end of the upper plate portion 2, and adapted to limit the pivotal movement of the operative member 40. On the front portion of the inner surface of the clipping portion 8 there is provided an auxiliary clipping means 9. This auxiliary clipping means 9 may be formed integrally with the upper plate portion 2, but may comprise an anti-slipping member of rubber or the like attached to the upper plate 2. Further, the surface of the auxiliary clipping means may be formed in waved shape. A groove 10 is provided substantially in the center of the inner surface of the upper plate portion 2 and in a shape in correspondence with that of the resilient member, in which groove the resilient member is fitted. Further, grooves 11, 11 are provided for the purpose of fitting supports 24, 24 for the shaft portions 25, 25, and the provision of these grooves 11, 11 in connection with the supports 24, 24 allows to make the clip thinner.

The lower clip member 20 comprises a lower plate portion 21 and the journals 25, 25 formed integrally with the lower plate portion 21 on the rear portion of the inside thereof. The journals 25, 25 are integrally extended outwardly from the supports 24, 24 which are formed integrally with the lower plate portion 21. The journals 25, 25 comprise e.g. circular cylindrical projections each of which may be provided at its end with a cutaway portion 26. By thus providing such cutaway portions 26, 26 on the journals 25, 25, the fitting of the journals 25, 25 into the bearing portions 4, 4 can be conveniently further facilitated. A semi-circular-sectioned engagement groove 27 is provided at the position behind the journals in the inside 22 of the lower plate portion 21. The engagement groove 27 serves for smoothening the pivotal movement of the operative member and preventing the disengagement thereof. The part of the lower plate portion 21 at which the engagement groove 27 is provided is smaller in width than the other part thereof. By thus reducing the rear end portion 28 of the lower plate portion 21 in width, the rear end portion 28 can be positioned in the space defined by a side wall 43, arms 48, 48 and a pivotal shaft 47 without necessity of making the operative member larger in width than the other part of the lower plate portion 21. The clipping portion 29 at the front portion of the inner surface of the lower plate portion 21 is provided with an auxiliary clipping means 30 similar to the abovementioned auxiliary clipping means 9. Therefore, this auxiliary clipping means 30 may be formed integrally with the lower plate portion 21 or may comprise an anti-slipping member of rubber or the like attached to the lower plate portion 21. A groove 31 is provided substantially in the center of the inner surface 22 of the lower plate portion and in a shape in correspondence with that of the resilient member 50 for the purpose of fitting the resilient member 50 thereinto. The groove 31 serves for engaging the resilient member 50 between the upper clip member 1 and the lower clip member 20 in cooperation with the abovementioned groove 10. Further conveniently, by providing a wall 32 integrally with the lower plate portion along the periphery of the groove 31, the resilient member 50 can be more surely engaged.

The operative member 40 comprises an attachment plate portion 42 provided therein with a slit 41, the side wall section 43 integrally extended from the attachment plate portion 42, the pivotal shaft 47 and arms 48, 48 projected inwardly at the ends respectively of side walls 44, 44 of the side wall section 43. To the attachment plate portion 42, one end of a belt or the like is attached. Further, a cutaway portion 45 may be provided at one side of the attachment plate portion 42. By thus providing such a cutaway portion 45 communicated with the slit 41, a preliminarily loop-shaped end of a belt or the like can be conveniently fitted thereto. Further, if the part 46 of the attachment plate portion to be covered with a belt or the like is made smaller in thickness than the other part of the attachment plate portion, the surface of the belt or the like at the part 46 is prevented from being raised beyond that of the other part of the attachment plate portion 42, thus providing comfortableness to wear. The pivotal shaft 47 has an at least semi-circular section and adapted to be engaged with the engagement groove 27. That is, at least the part of the pivotal shaft 47 to be in contact with the inner surface of the engagement groove 27 is semi-circular shape in section in correspondence with the shape of the engagement groove 27. The axis of the pivotal shaft 47 is positioned above the lower surface of the attachment plate portion 42. Such a positioning of the pivotal shaft 47 is very preferable since the lower surface of the attachment plate portion 42 is in the same plane with the outer surface of the lower clip member 20 when the pivotal shaft 47 of the operative member 40 is engaged with the groove 27 and predeterminedly operated to provide closing operation. The surface of the top end 71 of the arm is preferably formed in rounded shape in section so as to provide a smooth sliding movement. The arms 48, 48 may also be formed to be forwardly inclined with respect to the surface of the attachment plate portion 42 as shown in FIG. 10, conveniently permitting the opening pivotal force to be directed along the arms 48, 48. That is, this inclination angle may be determined in connection with the direction of the opening pivotal force.

The abovementioned upper clip member 1, especially the supporting portions 3, 3 thereof are integrally formed as shown in FIG. 7. That is, molds 60, 61 as jigs for integral molding are so set as to form the bearing portions 4, 4 at the same time. The contact surfaces 62, 62 between the molds 60, 61 are preferably inclined to extend substantially outwardly. The contact surfaces 62, 62 may be positioned to be vertical to the upper plate portion 2, if required. Consequently, the lower most points 63, 63 of the inner peripheral edge of bearing portions are located outside the imaginary plane vertical to the plate portion including the uppermost points 64, 64 of the outer peripheral edge of the bearing portion. By thus positioning the bearing portions, the upper clip member 1 can be integrally formed using such molds 60, 61, and also at the same time with the bearing portions 4, 4 conveniently. The resilient member 50 comprises a spiral member with two ends extended and mounted between the upper clip member 1 and the lower clip member 20.

The upper clip member 1, the lower clip member 20, the operative member 40 and the resilient member 50 formed as abovementioned are assembled into a clip in the following manner. Firstly, the resilient member 50 is fitted into the groove 31 of the lower clip member 20 and at the same time the pivotal shaft 47 of the operative member 40 is fitted into the engagement groove 27 of the lower clip member 20. In this case, the rear end portion 28 of the lower clip member 20 is positioned in the space defined by the side wall section 43 of the operative member 40, the pivotal shaft 47 and the arms 48, 48. Nextly, the upper clip member 1 is superposed on the lower clip member 20 so that the bearing portions 4, 4 and the journals 25, 25 are disposed in an opposed relation and the clip members 1, 20 are urged toward each other to fit the journals 25, 25 into the bearing portions 44, whereby the upper and lower clip members 1, 20 are pivotally connected.

This assembled clip is operated as follows. When the clip 1 is in open position e.g. as shown in FIGS. 1 or 8, the end portions 71, 71 of the arms 48, 48 of the operative member 40 are positioned at the connecting portion between the inner surface 7 of the upper plate portion 2 of the upper clip member 1 and the inner surface 72 of the rear end wall 12. Further, the arms 48, 48 are positioned between the rear end wall 12 and the rear end of the lower clip member 20. That is, in open position, the arms 48, 48 are not positioned in the space defined by the opposed inner surfaces of the upper plate portion 2 and the lower plate portion 21, but outside the same. In this case, when the operative member 40 is pivoted in the direction of A, the upper clip member 1 also makes a pivotal movement about the bearing portion 4 so that the end portion 71 of the arms 48, 48 can urges upwardly the rear end portion 73 of the upper clip member 1. By such a pivotal movement of the upper clip member 1, the clipping portions of the upper clip member 1 and the lower clip member 20 are brought into closed position. The clip in this position is shown in FIG. 9, in which the arms 48, 48 of the operative member 40 are positioned in the slide groove 6. Further, the end portion 74 of the rear end wall 12 of the upper clip member 1 is in contact with the upper surface 75 of the attachment plate portion 42 of the operative member 40. Consequently, the operative member 40 is prevented from making further pivotal movement, thereby providing a predetermined clipping force. Therefore, the clip 1 is kept in closed position. The end portion 74 of the rear end wall 12 is provided for the purpose of limiting the pivotal movement of the operative member 40 as abovementioned, and this end portion 74 is preferably so positioned that the lower surface 76 of the operative member 40 is substantially in the same plane with the outer surface 77 of the lower clip member 20. Further, the pivotal movement of the operative member 40 may be limited by the slide groove 6 instead of the rear end wall 12. Further, the slide groove 6 may be formed as shown in FIG. 11 to limit the pivotal movement in the direction A of the operative member 40, and in this case the rear end wall 12 is not necessarily provided. On the other hand, in order to bring the clipping portions into open position, the operation is carried out by providing the operative member 40 with the pivotal movement in the direction opposite to A.

According to the present invention, as above-mentioned, there is provided a clip which can be easily and economically manufactured and rapidly assembled, and in which damage given to the clip in assembling can be reduced, since the supporting portions provided with the bearing portions are formed to extend outwardly, and the journals can be formed integrally with the lower plate portions. Further, since the pivotal movement of the operative member is extremely smoothly achieved by means of the shaft and the engagement groove, unnecessary force is not applied to the clip during the process of the pivotal movement of the operative member, thereby reducing the damage given to each member of the clip in use and obtaining a great clipping force in spite of the small size of the clip as well as very surely maintaining the clipping portions in closed position. Furthermore, when the upper clip member is kept in open position, the end portion of the arms is positioned outside the space defined by the inner surfaces of the upper and lower plate portions, so that a thin small-sized and beautiful clip can be obtained.

What is claimed is:

1. A plastic clip comprising:

(a) an upper clip member comprising an upper plate portion having a front clipping end, a rear end, a pair of elongated sides extending between the front and rear ends, a pair of support portions extending downwardly from the sides of the upper plate portion adjacent the rear end thereof, each of the support portions having a bearing portion, the upper plate member having a slide surface positioned laterally inside of the support portions and rearwardly of the bearing portions, (b) a lower clip member comprising a lower plate portion having a front clipping end, a rear end, and a pair of elongated sides, a pair of journal supports extending upwardly from the lower plate portion adjacent the rear end thereof, a journal extending laterally outwardly from each of the journal supports beyond one of the sides of the lower plate portion, each of the journals being rotatably positioned in one of the bearing portions of the upper clip member and the sides of the lower plate portion adjacent the journals being positioned laterally inwardly of the support portions of the upper clip member whereby the upper and lower clip members are pivotally connected, the lower portion having an engagement groove therein rearwardly of the journals, (c) a resilient member positioned between the upper and lower clip members for resiliently urging the clipping ends thereof to pivot away from each other, and (d) an operative member having a rear attachment plate portion, a pair of spaced-apart side walls extending forwardly from the attachment plate portion, and a pivotal shaft extending between the side walls, the pivotal shaft of the operative member being rotatably positioned in the engagement groove of the lower clip member and the rear end of the lower clip member being positioned laterally inwardly of the side walls of the operative member, the side walls of the operative member being positioned laterally inwardly of the support portions of the upper clip member whereby the operative member is pivotally mounted on the lower clip member, the operative member, upper clip member, and lower clip member being movable between a first position in which the clipping ends of the upper and lower clip members are separated and a second position in which the clipping ends are brought together, the side walls of the operative member having arm portions which engage the upper plate portion of the upper clip member rearwardly of the slide surface when the members are in their first position and which engage the slide surface of the upper plate portion when the members are in the second position, pivoting movement of the operative member from its first position to its second position causing the upper clip member to pivot from its first position to its second position against the urging of the resilient member.

2. A plastic clip as claimed in claim 1, in which the bearing portions of the upper clip member comprises through openings and the lowermost point of the inner peripheral edge of each bearing portion is located outside the imaginery plane vertical to the plate portion including the uppermost point of the outer peripheral edge of the bearing portion.

3. A plastic clip as claimed in claim 1, in which the arm portions are formed to be inclined forwardly with respect to the surface of the attachment plate portion so that the end portion of the arm portions are located somewhat forward with respect to the axis of the pivotal shaft.

4. A plastic clip as claimed in claim 1, in which the arm portions are formed to be inclined rearwardly with respect to the surface of the attachment plate portion so that the end portion of the arm portions are located somewhat rearward with respect to the axis of the pivotal shaft.

5. A plastic clip as claimed in claim 1, in which a guide groove is provided in each of the inner surfaces of the pair of the supporting portions from the top thereof to the bearing portion provided on the upper plate portion for the purpose of facilitating the fitting of the journals into the bearing portions.

6. A plastic clip as claimed in claim 1, in which each of the journals is in the form of a circular cylindrical shape projected outwardly from each of the supports provided on the lower plate portion, and provided at its free end portion with a cut away portion for the purpose of facilitating the fitting of the journal into the bearing portion.

7. A plastic clip as claimed in claim 1, in which the engagement groove provided in the inner surface of the lower plate portion is of a semi-circular shape in section, and at least the part of the pivotal shaft to be in contact with the engagement groove is also of semi-circular shape in section in correspondence with the shape of the engagement groove.

8. A plastic clip as claimed in claim 1, in which a cut-away portion for the insertion of a looped end of a belt or the like is provided in the attachment plate portion so as to be communicated with the slit.

9. A plastic clip as claimed in claim 1, in which the upper clip member is provided with a rear end wall extended integrally from the rear end portion of the upper plate portion, so that the pivotal movement of the operative member in closing operation is limited by the contact of the end of the rear end wall against the operative member.

10. A plastic clip as claimed in claim 1, in which the lower surface of the operative member and the outer surface of the lower clip member are substantially in the same plane with each other when the clipping portions are in closed position.

11. A plastic clip as claimed in claim 1, in which at least one of the upper and lower clip members is provided with an auxiliary clipping means.

12. A plastic clip as claimed in claim 11, in which at least an auxiliary clipping means is integrally formed with the clip member.

13. A plastic clip as claimed in claim 11, in which at least an auxiliary clipping means is formed by attaching an anti-slipping member to the clip member.

* * * * *